United States Patent [19]

Denier et al.

[11] Patent Number: 4,735,398

[45] **Date of Patent: * Apr. 5, 1988**

[54] METHOD OF IMPROVING THE SERVICE LIFE OF PERMEABLE REFRACTORY ELEMENTS IN BOTTOMS OF METALLURGICAL VESSELS

[75] Inventors: Guy Denier, Metz, France; Romain Henrion, Esch/Alzette, Luxembourg

[73] Assignees: Institute de Recherches de la Siderurgie Francaise, Omaizieres-Metz, France; Arbed SA, Luxembourg, Luxembourg

[ * ] Notice: The portion of the term of this patent subsequent to Sep. 1, 2004 has been disclaimed.

[21] Appl. No.: 38,542

[22] Filed: Apr. 15, 1987

Related U.S. Application Data

[63] Continuation of Ser. No. 486,844, Apr. 20, 1983, Pat. No. 4,690,386.

[30] Foreign Application Priority Data

Apr. 22, 1982 [FR] France ..... 82 07118

[51] Int. Cl.[4] ..... C21C 5/44

[52] U.S. Cl. ..... 266/44; 266/281; 264/30

[58] Field of Search ..... 266/44, 280, 281, 246; 264/30

[56] References Cited

U.S. PATENT DOCUMENTS 4,298,378 11/1981 Murkami ..... 266/246
4,410,167 10/1983 Murkami ..... 266/246

*Primary Examiner*—L. Dewayne Rutledge
*Assistant Examiner*—S. Kastler
*Attorney, Agent, or Firm*—Michael J. Striker

[57] ABSTRACT

The service life of permeable refractory elements is improved by conserving in a vessel a fluid slag formed during refining of a charge after a liquid metal has been cast by tipping the vessel, depositing and spreading the slag over the bottom by bringing the vessel back to its upright position, and leaving the slag to harden and set on the bottom, while a sufficient pressure is maintained in the permeable refractory elements to ensure a permanent flow of a stirring fluid.

6 Claims, No Drawings

METHOD OF IMPROVING THE SERVICE LIFE OF PERMEABLE REFRACTORY ELEMENTS IN BOTTOMS OF METALLURGICAL VESSELS

This is a continuation of application Ser. No. 486,844 filed Apr. 20, 1983, now U.S. Pat. No. 4,690,386.

BACKGROUND OF THE INVENTION

The present invention relates to a metal production, particularly steel. More precisely it relates to metallurgical refining vessels, particularly steel-making converters with refining oxygen blown through the top and a bottom provided with permeable refractory elements.

Metallurgical processes are known in accordance with which a molten metal bath is subjected to pneumatic stirring or bubbling by controlled injection of a stirring fluid, usually an inert gas such as nitrogen or argon. The injection of the stirring fluid is performed through permeable refractory elements mounted in the usual refractory lining which forms the bottom of the vessel containing the bath. This is disclosed, for example, in the French patent No. 2,322,202 or U.S. Pat. No. 3,259,484.

This stirring technique for a steel-making converter with oxygen blown through the top is developed throughout the world under the commercial name "LBE process" (Lance-Brassage-Equilibre). This process tends to provide, as its name indicates, a balance between metal and slag and thus cumulate to a great extent the respective advantages of the conventional top oxygen blowing and bottom oxygen blowing refining processes.

Numerous solutions have been proposed for providing in the refractory elements sufficient selective permeability to ensure a satisfactory flow of stirring fluid and at the same time to avoid penetration of the molten metal in the reverse direction. One of these solutions is described in the published European patent application No. 21,861 and includes providing interstitial passages in a sealed refractory mass either by means of smooth-walled bodies incorporated in a monolithic refractory block, or by assembling together juxtaposed refractory plates with interposition of calibrated distance pieces therebetween.

These elements, like any refractory material, inevitably wear out in contact with the molten metal. The wear is further accelerated because of the gas blowing, which causes substantial convective movements of the liquid metal at the level of the blowing elements, and whose induced effects are also felt on the service life of the surrounding conventional refractory. Experience shows that in the case of traditional converters with oxygen blowing through the top (LD type) the bottom generally wears out less quickly than the refractory of the walls, whereas it is rather the opposite which occurs when the bottom of the converters is provided with permeable refractory elements.

SUMMARY OF THE INVENTION

Accordingly, it is an object of the present invention to provide a method for improving the service life of permeable refractory elements in a bottom of steel-making converters which avoids the disadvantages of the prior art.

More particularly, it is an object of the present invention to provide a method in accordance with which it is possible to slow down the rate of wear of permeable refractory elements provided in a bottom of a steel-making converter and at the same time to preserve their permeability.

In keeping with these objects and with others which will become apparent hereinafter, one feature of the present invention resides, briefly stated, in a method of improving the service life of permeable refractory elements in a bottom of a metallurgical vessel, such as a steel-making converter, in accordance with which a fluid slag formed during refining of a charge in the converter is conserved after a liquid metal has been cast by tipping of the converter, the slag is deposited and spread over the bottom of the converter by bringing the converter back to its upright position, and then the slag is left to harden and set on the bottom, while a sufficient pressure is maintained in the permeable refractory elements to ensure a permanent flow of receiving fluid.

The novel features which are considered characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

For improving the service life of permeable refractory elements provided in a bottom of a metallurgical vessel, such as a steel-making converter, a fluid slag formed during the refining of a charge is conserved in the converter after a liquid metal has been cast by tipping the converter. The slag is deposited and spread over the bottom of the converter by bringing the converter back to its upright position. Then the slag is left to harden and set on the bottom, while a sufficient pressure is maintained in the permeable refractory elements to ensure a permanent flow of a stirring fluid.

As an example, in the case of a steel-making converter with a capacity exceeding 200 t, the pressure maintained in the refractory elements provides a flow of stirring fluid on the order of about 30 $m^3/h$ per element.

Spreading of the slag over the bottom may be completed by rocking the converter to each side from its upright position.

While the invention is described with respect to the metallurgical refining vessel formed as a steel-making converter with oxygen blown through the top (LD type), it is to be understood that the invention also applies to any metallurgical vessel capable of rocking about a horizontal axis and carrying out a refining operation accompanied by formation of a slag.

The deposition of the slag in accordance with the present invention may be performed systematically after each charge, or at least after each charge leading to the permeable refractory elements being laid bare, even partially. The proposed method is simple and poses no difficulties which cannot be overcome. It involves only the precaution of forming, during or at the end of the refining of a charge, a slag capable because of its fluidity of flowing along the wall of the converter and then spreading out over the bottom and adhering to the bottom during hardening. In practice, that can be summed up for a man knowledgeable in the art to a visual check of the ability of the slag to comply with these three requirements, designated by the expression "a fluid slag is formed" used in the formulation of the subject of the invention.

If the slag is not fluid enough, its spreading and adherence (mechanical setting) to the bottom are no longer certain. For providing the required fluidity, fluidizing agents may be added at the end of refining, such as for example spath-fluor or another usual flux which lowers the melting temperature of the slag. Conversely, if the slag is too fluid, its hardening time is unnecessarily long, and it is to be feared that its melting point, which is relatively too low, will cause it to disappear from the beginning of the refining treatment of the next charge. In the latter case, thickening agents are added to the slag, such as for example dolomite or any other refractory oxide or mixture or refractory oxides currently used in steel-making.

When the slag is hardened and mechanically set on the bottom, it forms a refractory layer which protects the permeable elements from direct contact with the molten metal bath. The presence of the permeable elements in the bottom implies no other requirement during hardening of the slag than that it consists in maintaining a small flow of stirring fluid through the elements. This flow may be qualified as "safety flow" which in addition does not affect the productivity in any way, since it takes place during the down time for the necessary hardening of the slag.

While this flow may be considered as lost, since it is not used for treating the bath, it increases very little the overal costs of the operation, taking into account its relatively low value with respect to that used during stirring of the bath on the order of 150 $m^3/h$. It may be said that the consequences of the cost are practically negligible, if care is taken to choose a readily available gas, such as for example nitrogen, or a recovered gas produced in the works itself, such as $CO_2$.

When the slag layer is hardened, the converter is ready for a new charge. It is noted that at the beginning of the refining treatment not only is the permeability of the bottom conserved, but substantially increased with respect to the level that it had during the refining of charges without previous deposition of slag on the bottom.

A possible indicator of the permeability level may be formed by the pressure/flow rate ratio of the fluid in the duct conveying the fluid to the permeable refractory elements. This ratio may be normalized to a reference value taken when the element is in the new state by off-load blowing, or during the refining of the first charge in the converter.

The results obtained in the method according to the present invention are unexpected and not entirely clear. Observations show that the preservation of permeability is ensured by the presence of a network of channels connecting the blowing face of the element to the free surface of the bottom through the layer of the deposited slag. This network is formed during drying of the layer because of the permanent blow of stirring fluid. As for the improvement of the permeability, it could be a question of a phenomenon internal to the permeable refractory element. It may be thought a priori that the explanation is of thermal origin. Cooling of the bottom, whose effect is accentuated by the permanent flow of stirring fluid, is such as to create within the blowing elements mechanical stresses which, when released, give rise to a network of micro-cracks beginning preferentially in the wall of the original passages provided for the stirring fluid.

An explanation of aeromechanical nature may be conjectured, the stirring fluid being able in part to flow laterally in lesser pressure loss zones which are possibly formed at the interface between the deposited slag layer and the preexisting refractory bottom.

As mentioned above, the method in accordance with the invention can be used at any time, between any two charges of the same run, or even at the end of the first charge, in a converter in new condition.

It should be emphasized that since the service life of the permeable elements is improved, it is no longer the resistance of the bottom which limits the duration of a run. In other words, the bottom is no longer a problem for the wear of the converter, so that in this connection there is the same situation as in a conventional converter with oxygen blowing through the top (LD type).

The invention can be applied regardless of the type of permeable refractory elements used. Excellent results, however, are obtained with the elements mentioned at the beginning and further details of which are disclosed in the European patent application No. 21,861.

It will be understood that each of the procedural steps described above, or two or more together, may also find a useful application in other types of methods differing from the types described above.

While the invention has been illustrated and described as embodied in a method of improving the service life of permeable refractory elements provided in a bottom of metallurgical vessels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of improving the service life of permeable refractory elements provided in the bottom of a converter, the elements serving for controlled injection of a stirring fluid into a molten bath contained in the converter, the method comprising the steps of conserving in the converter a fluid slag formed during refining of a charge, after a liquid metal has been cast by tipping the converter, depositing and spreading the slag over the bottom by bringing the converter back to its upright position, wherein the slag has a sufficient fluidity to spread over the bottom, and leaving the slag to harden and set on the bottom while a sufficient pressure which ensures a permanent flow of the stirring fluid through the permeable refractory element is maintained in the permeable refractory element.

2. A method as defined in claim 1, wherein said spreading step includes rocking the vessel to each side from its upright position to facilitate the spreading of the slag.

3. A method as defined in claim 1; and further comprising the step of increasing the fluidity of the slag by adding a fluidizing agent into the vessel at least at the end of refining.

4. A method as defined in claim 3, wherein said adding step includes adding the fluidizing agent into the vessel during the refining.

5. A method as defined in claim 1; and further comprising the step of reducing the fluidity of the slag by adding a thickening agent into the vessel at least at the end of refining.

6. A method as defined in claim 5, wherein said adding step includes adding of the thickening agent into the vessel during the refining.

* * * * *